US009988825B1

(12) United States Patent
Parks

(10) Patent No.: US 9,988,825 B1
(45) Date of Patent: Jun. 5, 2018

(54) CLIP FACILITATING QUICK ASSEMBLY AND DISASSEMBLY OF FENCE COMPONENTS

(71) Applicant: Dwayne Scott Parks, Warren, MI (US)

(72) Inventor: Dwayne Scott Parks, Warren, MI (US)

( * ) Notice: Subject to any disclaimer, the term of this patent is extended or adjusted under 35 U.S.C. 154(b) by 298 days.

(21) Appl. No.: 14/724,257

(22) Filed: May 28, 2015

Related U.S. Application Data

(60) Provisional application No. 62/005,592, filed on May 30, 2014.

(51) Int. Cl.
*E04H 17/00* (2006.01)
*E04H 17/14* (2006.01)

(52) U.S. Cl.
CPC ..... *E04H 17/1421* (2013.01); *E04H 17/143* (2013.01); *E04H 2017/1452* (2013.01); *E04H 2017/1486* (2013.01)

(58) Field of Classification Search
CPC .... E04H 2017/1465; E04H 2017/1469; E04H 2017/1486; E04H 17/1421; E04H 17/143; E04H 17/1443; E04H 2017/1452; E04H 17/1434; E04H 17/1439; Y10T 403/7176; Y10T 24/44778; Y10T 24/44026; F16B 9/023
See application file for complete search history.

(56) References Cited

U.S. PATENT DOCUMENTS 2,501,940 A * 3/1950 Hibbard ..... A47J 45/071 16/425
2,614,827 A 10/1952 Peach et al. ..... 265/107
2,946,612 A 7/1960 Ahlgren ..... 292/17
3,756,567 A 9/1973 Murdock ..... 256/21
3,888,440 A * 6/1975 Rebentisch ..... A47B 57/42 248/222.13
3,949,836 A 4/1976 Russo ..... 182/194
3,955,801 A 5/1976 Soriero ..... 256/65
4,007,919 A * 2/1977 Totten ..... A01K 3/00 256/59
4,063,836 A * 12/1977 Militano ..... F16B 7/0446 182/228.6
4,506,419 A 3/1985 Mitomi ..... 24/297
4,691,897 A * 9/1987 Frush ..... E04F 11/1817 256/65.13
5,150,885 A 9/1992 Leone ..... 256/22
5,192,056 A 3/1993 Espinueva ..... 256/65
5,601,278 A * 2/1997 Graber ..... E04H 17/143 256/19
5,649,783 A 7/1997 Ichikawa et al. ..... 403/386
5,651,534 A * 7/1997 Yoder ..... E04H 12/2215 256/19
5,873,564 A * 2/1999 Bisch ..... E04H 17/003 256/59
6,042,296 A * 3/2000 Wittig ..... F16B 5/0642 24/297
6,155,741 A 12/2000 Took ..... 403/260
6,209,175 B1 4/2001 Gershenson ..... 24/297
(Continued)

*Primary Examiner* — Josh Skroupa
*Assistant Examiner* — Matthew R McMahon
(74) *Attorney, Agent, or Firm* — Christopher P. Maiorana, PC

(57) ABSTRACT

A clip includes a body, a tab, and a tang. The body may be configured to act as a spring. The tab extends upward from the body. The tang extends downwardly from the body.

19 Claims, 7 Drawing Sheets

(56) References Cited

U.S. PATENT DOCUMENTS

| | | | | |
|---|---|---|---|---|
| 6,299,143 | B1 * | 10/2001 | Valentine | E04H 17/1443 256/59 |
| 6,543,751 | B1 | 4/2003 | Spruill | 256/65.04 |
| 6,680,669 | B1 | 1/2004 | Terry | 340/5.64 |
| 7,025,335 | B2 * | 4/2006 | Zhu | E04H 17/1439 256/21 |
| 7,134,647 | B2 | 11/2006 | Graber | 256/65.02 |
| 7,152,849 | B2 | 12/2006 | Graber | 256/22 |
| 7,232,114 | B2 * | 6/2007 | Platt | E04H 17/1413 256/65.04 |
| 7,819,390 | B2 | 10/2010 | Godwin et al. | 256/22 |
| 8,177,195 | B2 | 5/2012 | Schall et al. | 256/22 |
| 8,403,303 | B2 | 3/2013 | Payne et al. | 256/22 |
| 2010/0270524 | A1 * | 10/2010 | Stanley | A01K 3/00 256/19 |

* cited by examiner

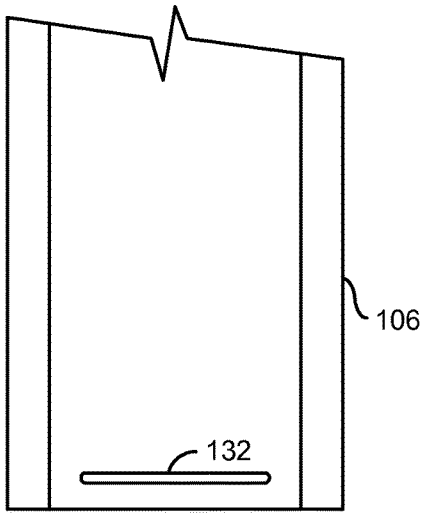
FIG. 4
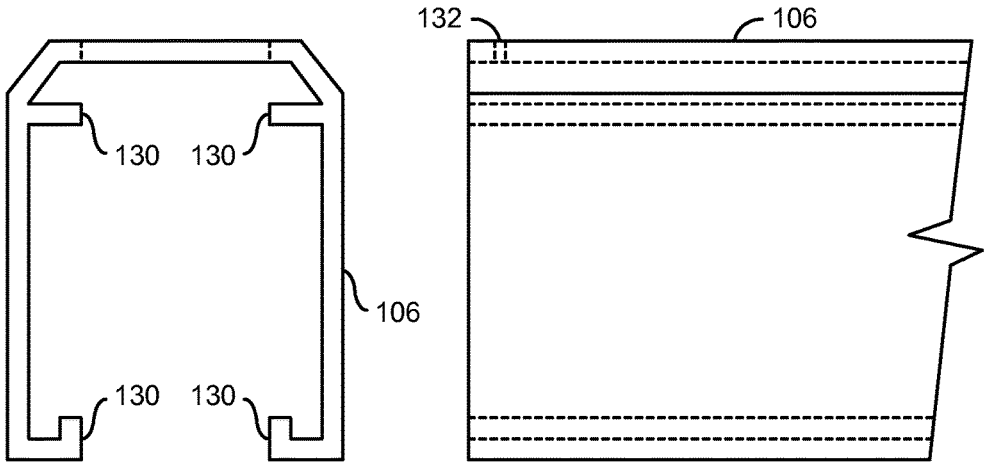

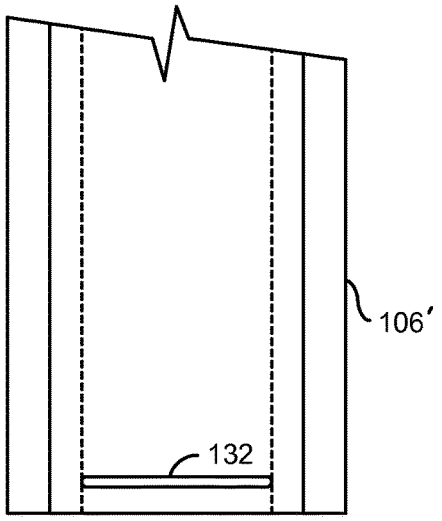
FIG. 8
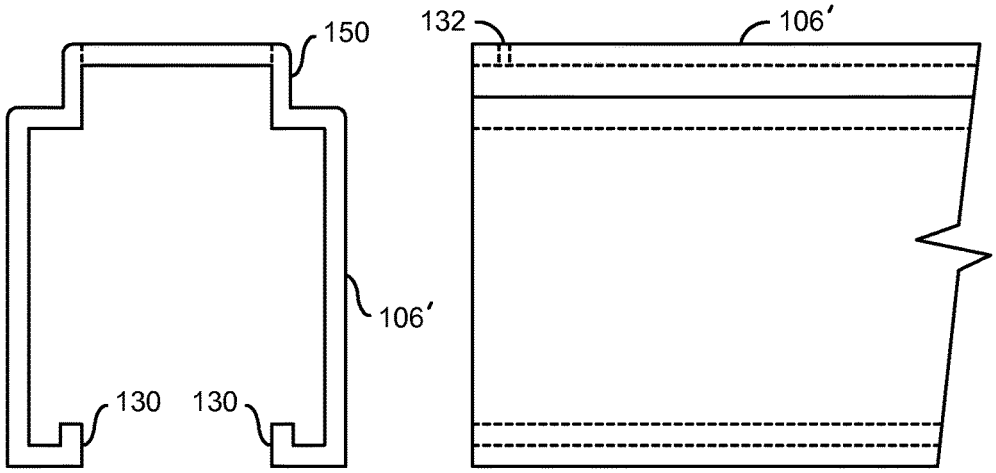

CLIP FACILITATING QUICK ASSEMBLY AND DISASSEMBLY OF FENCE COMPONENTS

This application relates to U.S. Provisional Application No. 62/005,592, filed May 30, 2014, which is incorporated by reference in its entirety.

FIELD OF THE INVENTION

The present invention relates to connectors generally and, more particularly, to a clip facilitating quick assembly and disassembly of fence components.

BACKGROUND OF THE INVENTION

Fence installers often set a first post in cement, insert a panel into the first post, insert the panel into a second post, set the second post in cement, then go back and screw the panel to the first post. As a general practice, these tasks are completed while the cement is still wet. In the frost-belt, this type of installation requires a longer post. By installing this way, there is always a chance that someone will lean on or bump into the panels, moving the posts and causing the posts to be crooked when the cement hardens. The posts take multiple steps to manufacture. Posts must be loaded into a machine twice; once to punch/route rail holes and once to drill screw holes. Hundreds of screws, longer posts, additional manufacturing steps, and increased installation time all increase the cost of the fence.

Sometimes panels need to be made shorter while on a job site, making it necessary to notch the end of the rails so that the rails will fit properly into their respective posts. If a panel needs to be shortened on the job site, the installer has a choice to either purchase a special tool (costing $200.00-$300.00) or try to notch the rails using a hack saw. Using a hack saw to notch the rails is very difficult, and increases costs and time on the job.

The panels of fences assembled using the conventional technique are not easily removable. If a panel is damaged, the posts must be removed to perform repairs. Consequently, repairs are extremely expensive. Another problem for consumers is insects (e.g., bees, etc.) building hives in the fence posts, because most aluminum fence products have no system in place to keep the insects out.

It would be desirable to implement a clip facilitating quick assembly and disassembly of fence components.

SUMMARY OF THE INVENTION

The present invention concerns a clip including a body, a tab, and a tang. The body may be configured to act as a spring. The tab extends upward from the body. The tang extends downwardly from the body.

The objects, features and advantages of the present invention include providing a clip facilitating quick assembly and disassembly of fence components that may (i) be simple to manufacture, (ii) allow easy assembly and disassembly of fence components by professionals and novices alike, (iii) reduce a number of tools needed during assembly and disassembly of fence components, (iv) reduce an amount of hardware used in building fences, (v) reduce labor costs for building fences, (vi) reduce material costs for fences, (vii) block insects (e.g., bees, wasps, yellow jackets, etc.) from nesting in fence post cavities, (viii) reduce repair costs substantially, and/or (ix) be hidden when fence components are assembled.

BRIEF DESCRIPTION OF THE DRAWINGS

These and other objects, features and advantages of the present invention will be apparent from the following detailed description and the appended claims and drawings in which:

FIG. 4 is a diagram showing an end view, a side view, and a top view of an illustrative embodiment of a fence rail;

FIG. 8 is a diagram showing an end view, a side view, and a top view of another illustrative embodiment of a fence rail;

DETAILED DESCRIPTION OF THE PREFERRED EMBODIMENTS

Figure 1:
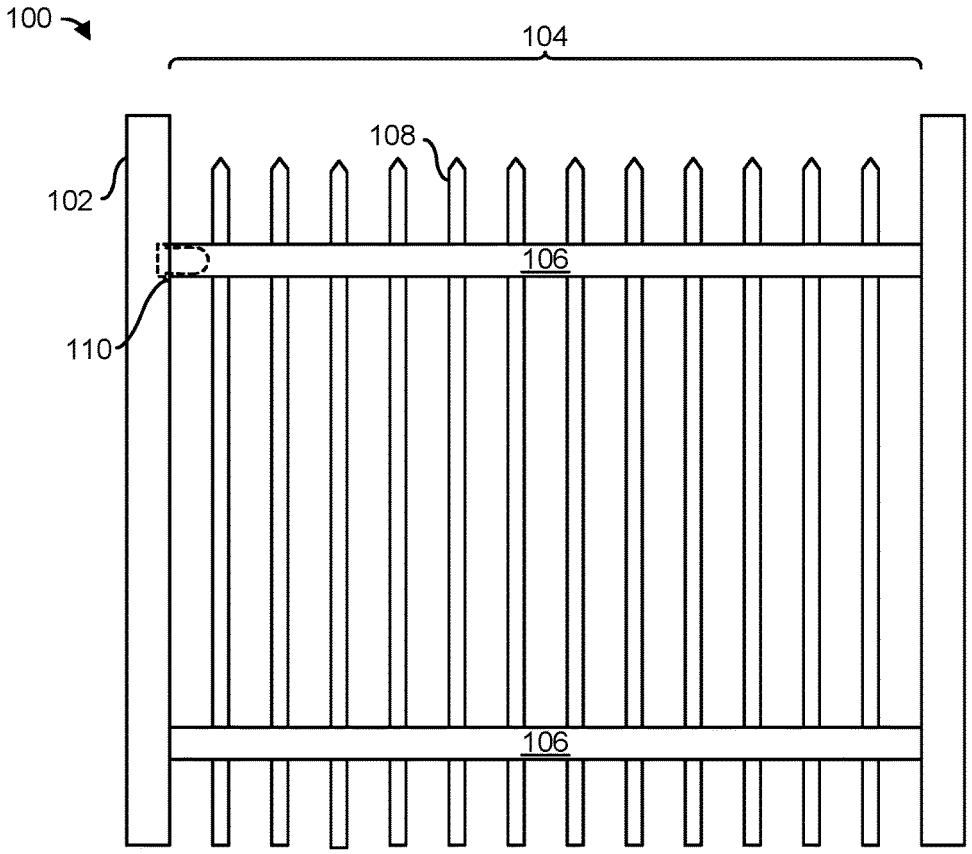
FIG. 1 is a diagram of a section of a fence illustrating application of a hidden clip in accordance with an embodiment of the invention.

Referring to FIG. 1, a diagram of a section of a fence 100 is shown illustrating application of a hidden clip in accordance with an embodiment of the invention. In various instances, the fence 100 comprises a number of fence posts 102 and a number of panels 104. The panel 104 comprises a number of fence rails (or simply rails) 106. In one example, the panel 104 may also comprise a number of pickets 108 attached to the rails 106. In another example, a solid panel (not shown) may be attached to the rails 106.

Each end of the rails 106 protrudes into one of the fence posts 102 and is held in place by a clip 110. The clips 110 are hidden from view within the rails and posts. The panel 104 is assembled to and disassembled from the posts 102 by compressing the clips 110 to slide the respective rail end into and out of the respective post 102.

Installers may set the posts 102 in cement (or concrete) using conventional techniques. The cement is allowed to harden before inserting the panels 104. Because the panels 104 are generally not assembled right away to the posts 102, there is far less chance the posts 102 will be disturbed before the cement has had a chance to harden. In addition, the clips 110 eliminate having to screw the panels 104 to the posts 102. Shorter posts may be used (even in the frost-belt) and installation time is significantly reduced, all of which reduces the cost of the fence.

Using the clip 110 in accordance with an embodiment of the invention, there is no need to notch the ends of the rails 106. Installers can simply make a straight cut and, with the same saw (e.g., a hack saw), score the top of the rail 106 to form a slot, insert the clip 110 into the rail 106, and insert the end of the rail 106 into an opening in the side of the post 102. The process in accordance with an embodiment of the invention reduces costs and time on the job.

The panels 104 are removable without tools. If a panel 104 is damaged, repairs can be performed without removing the posts 102. This substantially reduces repair costs for the consumer. In addition, the consumer can easily remove any panel 104 installed with the clips 110 to create an instant gate. Another benefit of the present invention is that the clips 110 block insects (e.g., bees, wasps, hornets, etc.) from gaining entry into cavities within the post 102 by filling the void between the rail 106 and the punched/routed hole in the post 102.

The posts 102 no longer need screws to hold the rails 106 in place. The posts 102 can be prepared for assembly with the rails 106 in a single step of inserting the posts 102 in a machine once to punch/route the rail hole. This significantly reduces manufacturing time and, therefore, reduces manufacturing costs.

Figure 2:
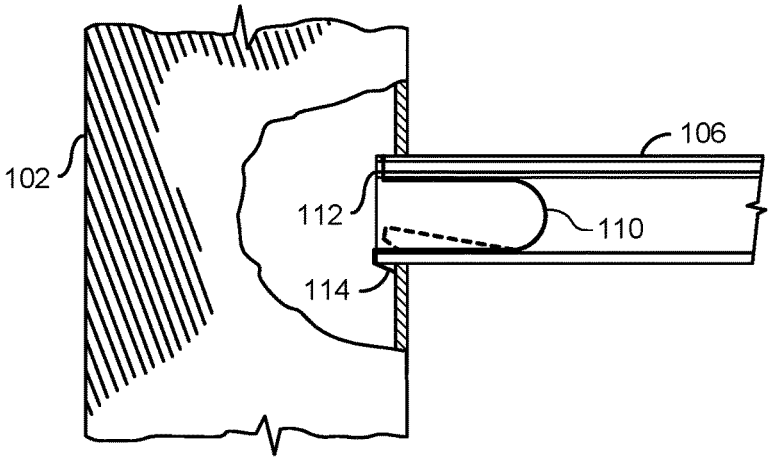
FIG. 2 is a cutaway view illustrating the hidden clip coupling a fence post and a fence rail shown in FIG. 1.

Referring to FIG. 2, a cutaway view is shown illustrating the hidden clip 110 coupling the fence post 102 and the fence rail 106 of FIG. 1. A tab 112 of the clip 110 extends above a body of the clip 110 and engages a slot in the top of the rail 106. The tab 112 generally holds the clip 110 in position in the rail 106. In an uncompressed state, a tang 114 of the clip 110 extends below the body of the clip 110 and through the bottom of the rail 106. The tang 114 of the clip 110 is configured to engage an interior surface of the post 102, thus preventing the rail 106 from being removed from the post 102 while the clip is uncompressed. When the clip 110 is compressed, the tang 114 rises up into the rail 106 (e.g., illustrated by a dashed line) allowing the rail 106 to be removed easily from the post 102.

Figure 3:
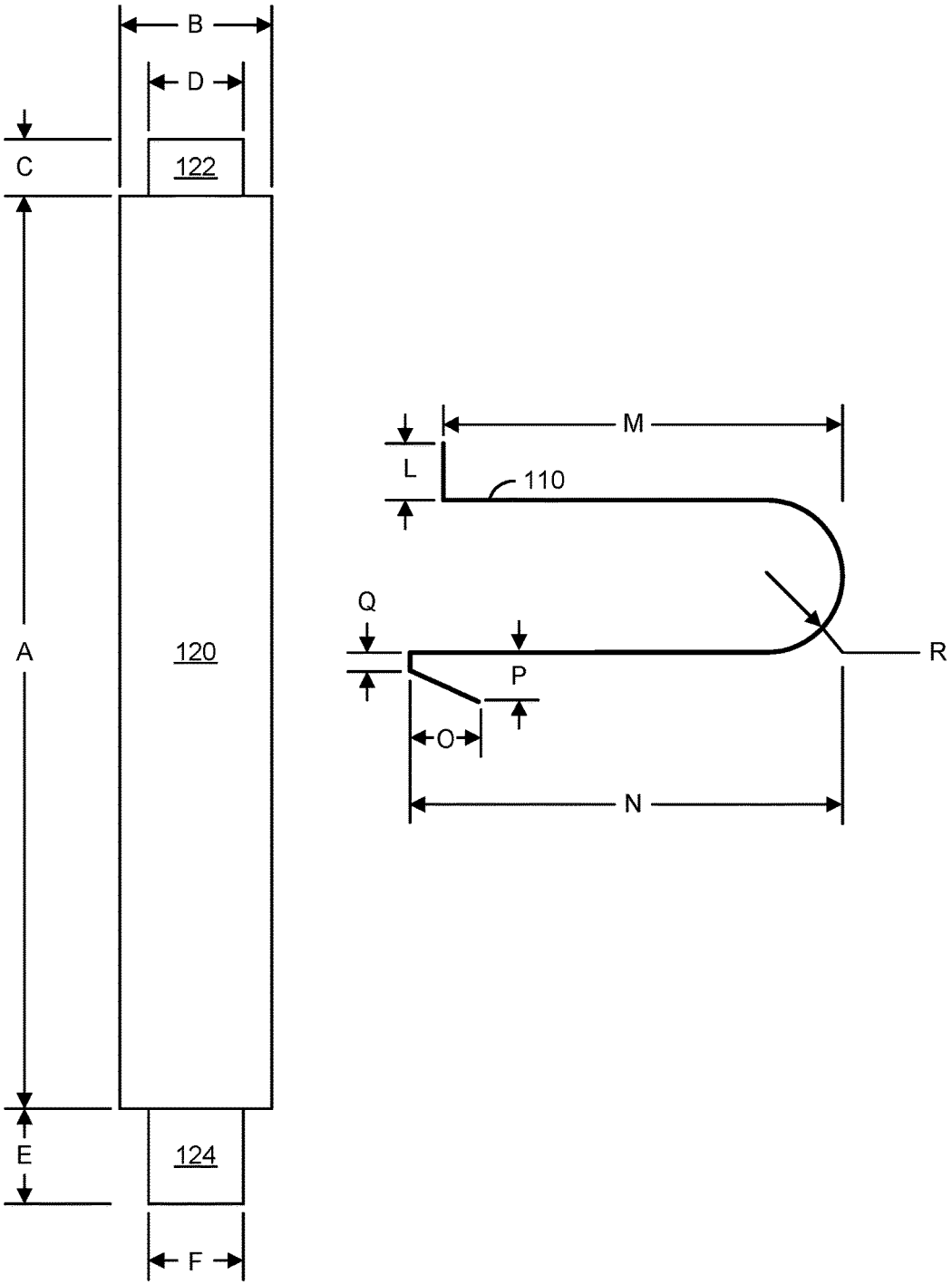
FIG. 3 is a diagram showing details of an illustrative embodiment of the hidden clip shown in FIGS. 1 and 2.

Referring to FIG. 3, a diagram is shown illustrating details of an illustrative embodiment of the clip 110 of FIGS. 1 and 2. In various embodiments, the clip 110 may be formed from a strip of metallic material (e.g., steel, aluminum, copper, nickel, tin, an alloy thereof, etc.). In some embodiments, the clip 110 may be formed from a non-metallic material (e.g., plastic, re-enforced Nylon, polyvinyl chloride (PVC), high-density polyethylene (HDPE), etc.). However, other materials with similar properties may be used to form the clip 110. In embodiments utilizing metallic materials, the metallic material may be treated to prevent oxidation or corrosion (e.g., zinc coated, oxide coated, anodized, stainless steel, etc.).

In one example, the clip 110 may be formed from a strip of material having a first portion 120, a second portion 122, and a third portion 124. The first portion 120 may be bent to form a body of the clip 110. The body of the clip 110 compresses when pressure is applied and returns to an uncompressed state when pressure is removed. The second portion 122 may be bent to form the tab 112 on the top of the clip 110. The third portion 124 may be bent to form the tang 114 on the bottom of the clip 110. Various dimensions (e.g., A, . . . , R) of the clip 110 are illustrated if FIG. 3. In one example, the clip 110 may be implemented with the following dimensions:

A=about 6 inches;
B=about 1 inch;
C=about 0.375 of an inch;
D=about 0.675 of an inch;
E=about 0.675 of an inch;
F=about 0.675 of an inch;
L=about 0.375 of an inch;
M=about 2.63 inches;
N=about 2.88 inches;
O=about 0.45 of an inch;
P=about 0.25 of an inch;
Q=about 0.125 of an inch;
R=about 0.5 of an inch.

However, one or more dimensions may be varied to meet the design criteria of a particular implementation. In one instance, dimensions L, M, O, and R may be varied as follows:

L=about 0.21 inches;
M=about 2.84 inches;
O=about 0.458 of an inch;
R=about 0.375 of an inch.

In various embodiments, the tang 114 may form an angle of approximately 24 degrees with the bottom of the clip 110.

Referring to FIG. 4, a diagram is shown illustrating an end view, a side view, and a top view of an illustrative embodiment of the fence rail 106 of FIG. 1. In one example, the fence rail 106 comprises a number of internal ribs 130. In one example, the rail 106 may be implemented as an aluminum extrusion. The clip 110 is generally configured to engage the ribs 130 (e.g., illustrated below in connection with FIG. 5). A slot 132 is disposed near the end of the rail 106. In various embodiments, the slot 132 is punched or cut into a top surface of the rail 106. When the clip 110 is inserted into the rail 106, the tab 112 on the top of the clip 110 protrudes into the slot 132, locking the clip 110 into position in the end of the rail 106. The tang 114 on the bottom of the clip 110 (shown in FIG. 2) protrudes through the opening (void) in the bottom of the rail 106 to engage the inner surface of the post 102 when the rail 106 is inserted into the post 102.

Figure 5:
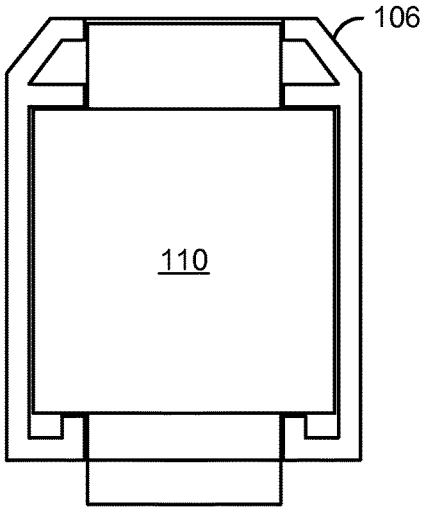
FIG. 5 is a diagram illustrating a clip in accordance with an embodiment of the invention blocking off an end of a fence rail and preventing access by insects to an internal cavity of a fence post.

Referring to FIG. 5, a diagram is shown illustrating the clip 110 in accordance with an embodiment of the invention blocking off an end of the fence rail 106. By blocking off the opening in the end of the rail 106, the clip 110 prevents access by insects (e.g., bees, wasps, hornets, etc.) to an internal cavity of the fence posts 102. The dimensions of the rail 106 and the clip 110 are configured such that the small exposed spaces between the rail 106 and the clip 110 do not afford the insects access to the inside of the post 102 or the shelter needed for building hives (nests).

Figure 6:
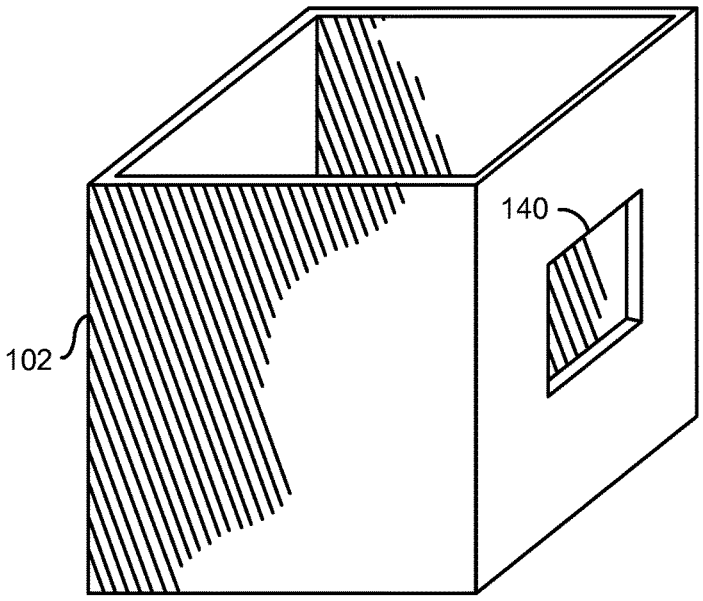
FIG. 6 is a perspective view of an illustrative embodiment of a fence post.

Referring to FIG. 6, a perspective view of an illustrative embodiment of a fence post 102 is shown. The fence posts 102 have openings 140 into which the rails 106 are inserted. The openings 140 are configured generally to allow the rails 106 to be swung out of alignment with a plane of the fence, facilitating easy removal of the panels 104 (described below in connection with FIG. 9). The dimensions of the openings 140 are configured such that the small exposed spaces between the rails 106 and edges of the openings 140 do not afford the insects access to the inside of the post 102 or the shelter needed for building hives (nests).

Figure 7:
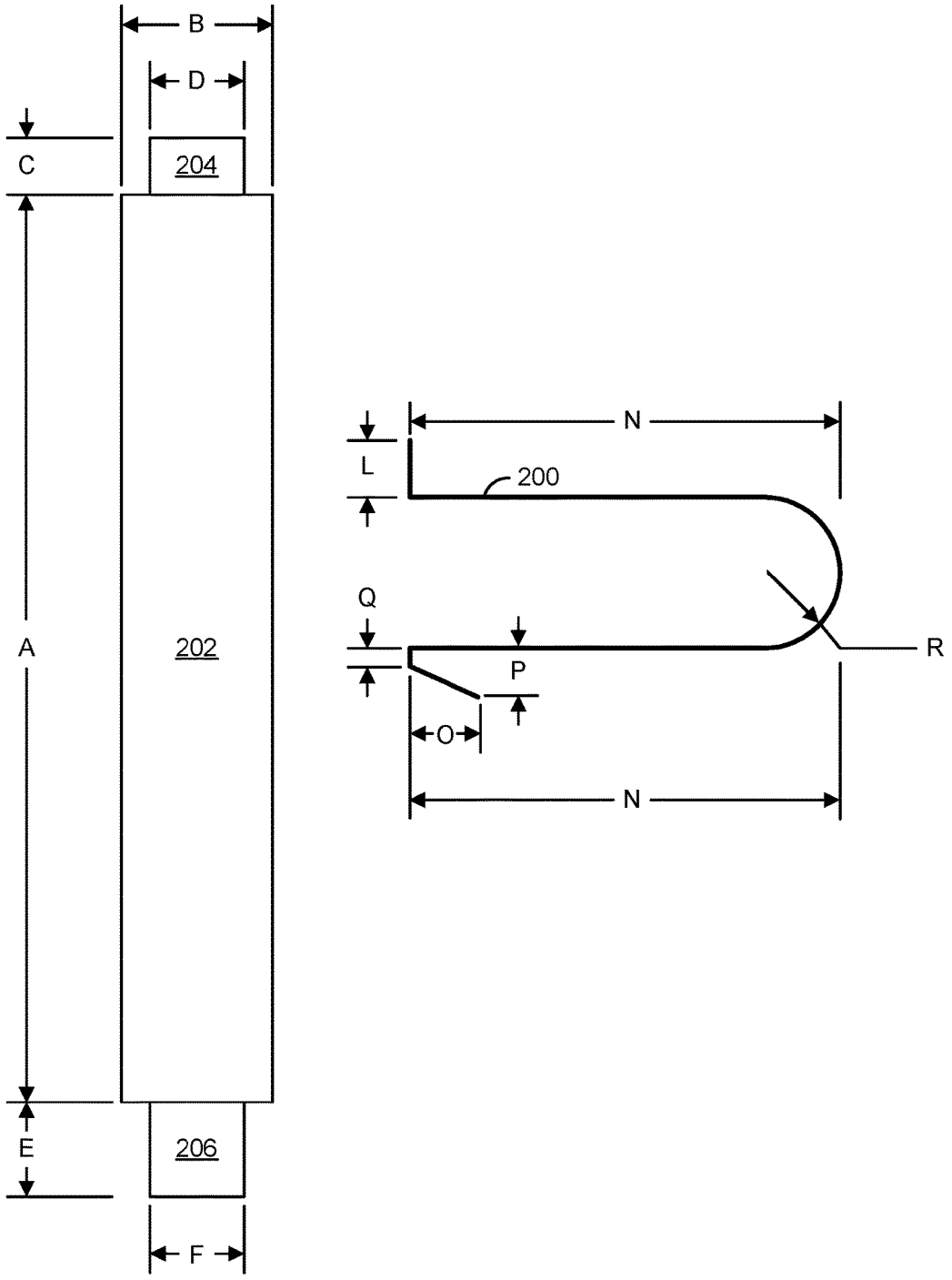
FIG. 7 is a diagram showing details of another illustrative embodiment of the hidden clip of FIGS. 1 and 2.

Referring to FIG. 7, a diagram of a clip 200 is shown illustrating details of another illustrative embodiment in accordance with the invention. The clip 200 may be used in place of the clip 110 shown in FIGS. 1 and 2. In various embodiments, the clip 200 may be formed from a strip of metallic material (e.g., steel, aluminum, copper, nickel, tin, an alloy thereof, etc.). In some embodiments, the clip 200 may be formed from a non-metallic material (e.g., plastic, re-enforced Nylon, polyvinyl chloride (PVC), high-density polyethylene (HDPE), etc.). However, other materials with similar properties may be used to form the clip. In embodiments utilizing metallic materials, the metallic material may be treated to prevent oxidation or corrosion (e.g., zinc coated, oxide coated, anodized, stainless steel, etc.).

In one example, the clip 200 may be formed from a strip of material have a first portion 202, a second portion 204, and a third portion 206. The first portion 202 may be bent to form a body of the clip 200. The body of the clip 200 compresses when pressure is applied and returns to an uncompressed state when pressure is removed. The second portion 204 may be bent to form a tab similar to the tab 112 on the top of the clip 110. The third portion 206 may be bent to form a tang similar to the tang 114 on the bottom of the clip 110. Exemplary dimensions (e.g., A, . . . , R) of the clip 200 are illustrated if FIG. 7. In one example, the clip 200 may be implemented with the following dimensions:

A=about 4.19 inches;
B=about 0.975 inch;
C=about 0.370 of an inch;
D=about 0.615 of an inch;
E=about 0.615 of an inch;
F=about 0.615 of an inch;
L=about 0.370 of an inch;
N=about 1.95 inches;
O=about 0.450 of an inch;
P=about 0.315 of an inch;
Q=about 0.167 of an inch;
R=about 0.255 of an inch.

However, other dimensions may be implemented to meet the design criteria of a particular implementation. In one instance, the tang may form an angle of approximately 24 degrees with the bottom of the clip 200. In contrast to the clip 110, the tab of the clip 200 formed by the second portion 204 and the bend of tang of the clip 200 formed by the third portion 206 are equally distanced from an apex of a radius R in the body of the clip 200.

Referring to FIG. 8, a diagram a fence rail 106' is shown illustrating an end view, a side view, and a top view of another illustrative embodiment in accordance with the invention. In one example, the fence rail 106' comprises a number of lower internal ribs 130 similar to the rail 106. However, instead of having upper internal ribs 130, a top contour 150 of the fence rail 106' is configured to engage the clip 110 when the clip 110 is inserted. In various embodiments, the rail 106' may be implemented as an aluminum extrusion. However, other materials may be used to implement the fence rail 106'. The clip 110 is generally configured to engage the ribs 130 and an upper contour 150. A slot 132 is disposed near the end of the rail 106'. In one example, the slot 132 may punched into a top surface of the rail 106'. In another example, the slot 132 may be formed by cutting (or scoring) the top contour 150 (e.g., using a hacksaw) during construction (or customization) of a section of a fence. The tab 112 on the top of the clip 110 protrudes into the slot 132, locking the clip 110 into position in the end of the rail 106'. The tang 114 on the bottom of the clip 110 (illustrated in FIG. 2) protrudes through the opening (void) in the bottom of the rail 106' to engage the post 102 when the rail 106' is inserted in the post 102.

Figure 9:
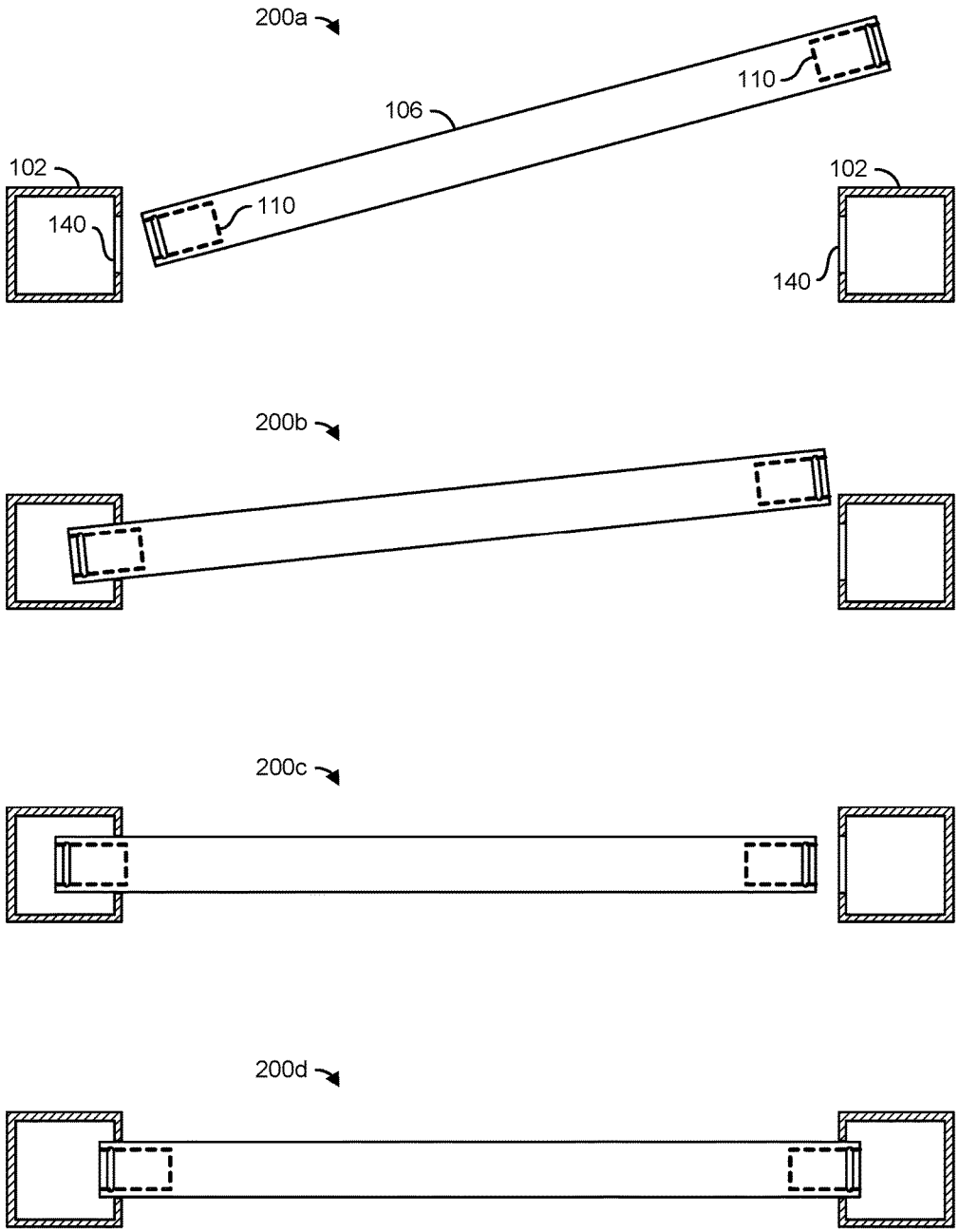
FIG. 9 is a diagram illustrating a process of assembling and disassembling a fence in accordance with an embodiment of the invention.

Referring to FIG. 9, diagrams 200*a*-200*d* are shown illustrating an assembly/disassembly process for a fence constructed in accordance with an embodiment of the invention. The rails 106 are shown without attached panels for clarity. During an initial stage of assembly, first and second posts 102 are set in cement with a desired spacing and the cement is allowed to harden. As illustrated in diagram 200*a*, a rail 106 is cut to a length determined by the spacing of the posts 102, slots are punched/cut into a top surface near each end of the rail 106, and a clip 110 is inserted into each end of the rail 106. As illustrated in diagram 200*b*, a first end of the rail 106 is inserted into an opening in a side surface of the first post 102. As illustrated by diagram 200*c*, a second end of the rail 106 is aligned with an opening in a side surface of the second post 102. Then, as illustrated in diagram 200*d*, the rail 106 is slid until the second end of the rail 106 passes through the opening in the side surface of the second post 102 and the clip 110 engages an internal surface of the second post 102. Once assembled, the section of fence may be disassembled by compressing each of the clips 110 while reversing the actions illustrated in the diagrams 200*a*-200*d*.

The terms "may" and "generally" when used herein in conjunction with "is(are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to the preferred embodiments thereof, it will be understood by those skilled in the art that various changes in form and details may be made without departing from the scope of the invention.

The invention claimed is:

1. A fence comprising:

a) a rail having an open end, an open bottom, and a slot disposed in a top surface adjacent the open end;

b) a post having an opening disposed in a side surface; and c) a clip configured to be disposed within the open end of said rail, said clip comprising a U-shaped body, a tab extending upward from said U-shaped body, and a tang having a bend defining a first portion and a second portion, said first portion extending downward from said U-shaped body and said second portion angling downward and toward a curved section of said U-shaped body, wherein (a) when said clip is disposed within the open end of said rail, said curved section of said U-shaped body is contained within said rail, said tab extends into and does not protrude through said slot in said top surface of said rail, and said second portion of said tang extends below the open bottom of said rail, and (b) when the end of said rail with said clip is being slid through the opening in said side surface of said post, said tang is displaced from a first position by an edge of the opening in the side surface of the post, and said tang returns to said first position when said tang is disposed through the opening in said side surface of said post, removably securing said rail and said post to one another.

2. The fence according to claim 1, wherein said second portion of said tang of said clip is configured to act as a barb.

3. The fence according to claim 1, wherein said second portion of said tang of said clip forms an acute angle with said body of said clip.

4. The fence according to claim 1, wherein said second portion of said tang of said clip forms an angle of approximately 24 degrees with said body of said clip.

5. The fence according to claim 1, wherein said clip is further configured such that said tab extends upward from said U-shaped body approximately three-eighths of an inch, an end of said tang is separated from said U-shaped body by approximately one-quarter of an inch, said curved section has a radius of approximately one-half of an inch, and said U-shaped body has a width of approximately one inch and a length of approximately three inches.

6. The fence according to claim 1, wherein said clip is further configured such that said tab extends upward from said U-shaped body approximately one-quarter of an inch, an end of said tang is separated from said U-shaped body by approximately one-quarter of an inch, said curved section has a radius of approximately three-eighths of an inch, and said U-shaped body has a width of approximately one inch and a length of approximately three inches.

7. The fence according to claim 1, wherein said clip is further configured such that said tab extends upward from said U-shaped body approximately three-eighths of an inch, an end of said tang is separated from said U-shaped body by approximately five-sixteenths of an inch, said curved section has a radius of approximately one-quarter of an inch, and said U-shaped body has a width of approximately fifteen-sixteenths of an inch and a length of approximately two inches.

8. The fence according to claim 1, wherein said clip is formed using a material selected from the group consisting of steel, aluminum, copper, nickel, tin, plastic, re-enforced Nylon, polyvinyl chloride (PVC), and high-density polyethylene (HDPE).

9. The fence according to claim 1, wherein said clip is formed using a material comprising an alloy of one or more of steel, aluminum, copper, nickel, zinc, and tin.

10. The fence according to claim 1, wherein said clip is formed using stainless steel.

11. The fence according to claim 1, wherein said U-shaped body of said clip is configured to act as a spring.

12. The fence according to claim 1, wherein said clip is configured to fit within a number of internal ribs of said rail.

13. The fence according to claim 1, wherein said rail is configured to support a panel of said fence between two posts.

14. The fence according to claim 1, wherein dimensions and dimensions of said rail are configured such that an inner surface of said rail and said clip are substantially flush with one another when assembled to prevent insects from accessing an inner space of said post.

15. The fence according to claim 1, wherein dimensions and dimensions of said rail are configured such that an inner surface of said rail and said clip are substantially flush with one another when assembled to prevent one or more of bees, wasps, and hornets from accessing an inner space of said post.

16. An assembly comprising:

a first member having an open end, an open bottom, and a slot disposed in a top surface adjacent the open end;

a second member having an opening disposed in a side surface; and a clip configured to be disposed within the open end of said first member, said clip comprising a U-shaped body, a tab extending upward from said U-shaped body, and a tang having a bend defining a first portion and a second portion, said first portion extending downward from said U-shaped body and said second portion angling downward and toward a curved section of said U-shaped body, wherein (a) when said clip is disposed within the open end of said first member, said curved section of said U-shaped body is contained within said first member, said tab extends into and does not protrude through said slot in said top surface of said first member, and said second portion of said tang extends below the open bottom of said first member, and (b) when the open end of said first member with said clip is being slid through the opening in said side surface of said second member, said tang is displaced from a first position by an edge of the opening in the side surface of the second member, and said tang returns to said first position when said tang is disposed through the opening in said side surface of said second member, removably securing said first member and said second member to one another.

17. The assembly according to claim 16, further comprising a third member having an opening disposed in a side surface and a second clip, wherein:

said first member has a second open end and a second slot disposed in said top surface adjacent the second open end; and said second clip is configured to be disposed within the second open end of said first member, said second clip comprising a U-shaped body, a tab extending upward from said U-shaped body, and a tang having a bend defining a first portion and a second portion, said first portion extending downward from said U-shaped body and said second portion angling downward and toward a curved section of said U-shaped body, wherein (a) when said second clip is disposed within the second open end of said first member, said curved section of said U-shaped body is contained within said first member, said tab extends into and does not protrude through said second slot in said top surface of said first member, and said second portion of said tang extends below the open bottom of said first member, and (b) when the second open end of said first member with said second clip is being slid through the opening in said side surface of said third member, said tang is displaced from a first position by an edge of the opening in the side surface of the third member, and said tang returns to said first position when said tang is disposed through the opening in said side surface of said third member, removably securing said first member and said third member to one another.

18. The assembly according to claim 17, wherein said first member supports a fence panel.

19. The assembly according to claim 17, wherein the slots in the top surface of the first member are formed using a punch, a router, or a saw.

* * * * *